United States Patent [19]

Brashears et al.

[11] Patent Number: 4,515,090

[45] Date of Patent: May 7, 1985

[54] SOLID FUEL BURNER

[75] Inventors: David F. Brashears, Oviedo; Joseph T. Mollick, Longwood, both of Fla.

[73] Assignee: Mechtron International Corp., Orlando, Fla.

[21] Appl. No.: 560,439

[22] Filed: Dec. 12, 1983

[51] Int. Cl.[3] ..... F23C 1/10; F23K 5/00

[52] U.S. Cl. ..... 110/264; 110/265; 110/347

[58] Field of Search ..... 110/260–265, 110/347

[56] References Cited

U.S. PATENT DOCUMENTS

| | | | |
|---|---|---|---|
| 2,320,576 | 6/1943 | Dunn | 110/265 |
| 2,921,542 | 1/1960 | Kidwell et al. | 110/265 |
| 2,957,436 | 10/1960 | Lotz | 110/265 |
| 4,132,180 | 1/1979 | Fredrick | 110/265 |
| 4,147,116 | 4/1979 | Graybill | 110/264 |
| 4,241,673 | 12/1980 | Smith et al. | 110/265 |
| 4,326,702 | 4/1982 | Oueneau et al. | 110/264 |
| 4,333,405 | 6/1982 | Michelfelder et al. | 110/264 |
| 4,400,151 | 8/1983 | Vatsky | 110/264 |
| 4,422,389 | 12/1983 | Schroder | 110/264 |
| 4,428,309 | 1/1984 | Chang | 110/265 |

FOREIGN PATENT DOCUMENTS

| | | | |
|---|---|---|---|
| 57-49707 | 3/1982 | Japan | 110/265 |

*Primary Examiner*—Henry C. Yuen

*Attorney, Agent, or Firm*—William M. Hobby, III

[57] ABSTRACT

A solid fuel burner apparatus is provided having a combustion chamber surrounded by a housing and having a solid fuel and primary air nozzle attached to the combustion chamber and located in the housing for directing pulverized solid fuel and air into the combustion chamber. A solid fuel and primary air input is connected through the housing to the solid fuel and primary air nozzle for directing solid fuel thereinto. A secondary air input is connected to the housing for directing air under pressure into the housing and from the housing into the combustion chamber. The housing is divided between first and second compartments and a proportioning damper system divides the input secondary air between the first and second compartments of the housing. Dampers are used to proportion secondary air between first and second compartments from an inlet plenum and diffusion vanes direct the primary and solid fuel into the combustion chamber with a predetermined pattern to control the flame.

5 Claims, 5 Drawing Figures

SOLID FUEL BURNER

BACKGROUND OF THE INVENTION

The present invention relates to industrial burners and especially to industrial burners adapted to utilize a variety of fuels, including dehydrated pulverized organic materials.

Large, high capacity fuel burners are generally used in industries requiring drying of various materials. For example, such burners are required for operating large, rotary aggregate dryers and for kiln drying and processing of lime, bauxite, sand, coal, cement, and the like. In the making of asphalt roads, drying units are used for drying the aggregate before mixing with the asphalt.

In drying aggregate, as an example of an application of the fuel burners in consideration, a typical unit may have a rotating, horizontal drum 30 feet in length and 8 feet in diameter. The wet rock is introduced into one end of the drum, carried to the top of the drum and dropped back. The material is gradually carried to the opposite end of the drum and removed by a conveyor. A fuel burner which may have an outlet chamber of from one or more feet in diameter is placed at one end of the drum. The hot gases and air emanating from the burner are directed through the falling aggregate, known as the aggregate curtain, and serves to dry out all moisture from the material. An exhaust fan at the output end of the drum draws the heated air therethrough. The gas temperature at the burning input end may be on the order of 2400° F., dropping to about 350° F. at the opposite end of the drum. In large dryers such as described above, the burners are required to produce as much as 200 million btu's per hour.

In the past, a variety of fuels have been utilized in burners, but by in large, recent burners have used natural gas or fuel oil. In recent years, the absence of certain types of fuels in different parts of the country has resulted in entire manufacturing plants not being able to operate because of the lack of the type of fuel the plant is designed to use. As a result of this, more and more industrial burners are designed to use more than one type of fuel, and may for instance, use pulverized coal and natural gas with the ability to switch from one to the other as price and availability dictate. It has also been suggested in prior years to utilize wood or other organic materials in pulverized form for operating burners. However, when fuel oil and natural gas were less expensive, systems using organic energy were not economically feasible. But, with a rapidly escalating price of oil, industrial burners which utilize pulverized organic materials appear to be more desirable.

In the present invention, organic materials are dehydrated and pulverized to desirable moisture content of approximately twenty percent (20%). The desired particles are then forced at high pressure through pelletizing mills. The result is a pellet about a quarter of an inch in diameter and about three quarters of an inch long ($\frac{1}{4}\times\frac{3}{4}$). These pellets then are used in specially designed industrial burners, which may also have the capability of using gas or oil as a back-up fuel. The pellets can be made from any vegetable or organic matter, such as scrapboard chips, hay, sugar cane, left over from forest products industries, municipal refuge and other waste materials that are generally regarded as sources of pollution. The cost of the pellets utilizing various and otherwise waste materials is now competitive with other fuels and in many cases, the cities are now paying to haul organic materials to landfills and to separate and sell the usable material to a pellet manufacturer. The present burner can then take the pelletized material for operating the burners, but in the event that sufficient pelletized material is not available, the burner can alternatively switch from the pellet fuel to gas, or used dried organic material without pelletizing.

A typical U.S. patent which shows the use of pulverized fuel and oil either alone or simultaneously can be seen in U.S. Pat. No. 2,111,980 for a Combustion Apparatus. However, such prior art pulverized fuel burners have utilized pulverized coal and frequently have combined pulverization with gas or oil burners used in combination. Other powdered fuel burners can be seen in U.S. Pat. Nos. 1,618,808 and 3,777,678. These patents suggest using dual walled burners with combustion air being fed between the walls into the combustion chamber. U.S. Pat. No. 4,351,251 shows a burner for dehydrated pulverized organic materials. U.S. Pat. No. 3,391,981 to Voorheis, et al., shows a forced air draft burner for combustable gases having a concentric annular air delivery paths and means for spinning air in two paths in opposite directions.

In contrast to the prior art, the present burner is a solid fuel burner which is adapted to utilize oil or gas and which provides a specific proportioning system for proportioning secondary air and specific rotation means for rotating the primary and secondary air into a reaction zone just beyond the oil nozzle to create intense mixing of the air and solid fuel to create an intense ignition point.

SUMMARY OF THE INVENTION

A pulverized solid fuel burner apparatus has a combustion chamber and a burner housing with a solid fuel and primary air nozzle located in the housing and attached to the combustion chamber for directing pulverized solid fuel and air into the combustion chamber. A solid fuel and primary air input is connected to the solid fuel and primary air nozzle for directing the solid fuel into the nozzle. The input is connected at an angle through housing and spirals around the nozzle to introduce the solid fuel and primary air in a spiral into the nozzle. A secondary air input means directs air under pressure through the housing into the combustion chamber. The housing is divided by a bulk head into first and second compartments with the solid fuel and primary nozzle extending therethrough. A proportioning means divides the input secondary air between the housing's first and second compartments with the first compartment directing air into the combustion chamber through an annular opening around the solid fuel and primary air nozzle and the second compartment directing air through the solid fuel and primary nozzle and through a second annular opening around the solid fuel nozzle. Air registers adjacent the first annular opening and vanes in the second annular opening direct the secondary air into different directions of rotation. The proportioning means includes adjustable dampers for directing predetermined proportions of the secondary air between the first and second compartment. Adjustment of the dampers adjusts the flame in the combustion chamber for different fuel inputs. A liquid fuel nozzle is mounted at the mouth of the solid fuel and primary air nozzle and may have a diffuser attached adjacent thereto postioned to rotate the solid fuel and primary air, as well as the secondary air passing through the nozzle in the same direction, but in an opposite direction from the secondary air entering the combustion chamber from the first secondary air compartment.

BRIEF DESCRIPTION OF THE DRAWINGS

Other objects, features and advantages of the present invention will be apparent from the written description and the drawings, in which.

DESCRIPTION OF THE PREFERRED EMBODIMENTS

Figure 1:
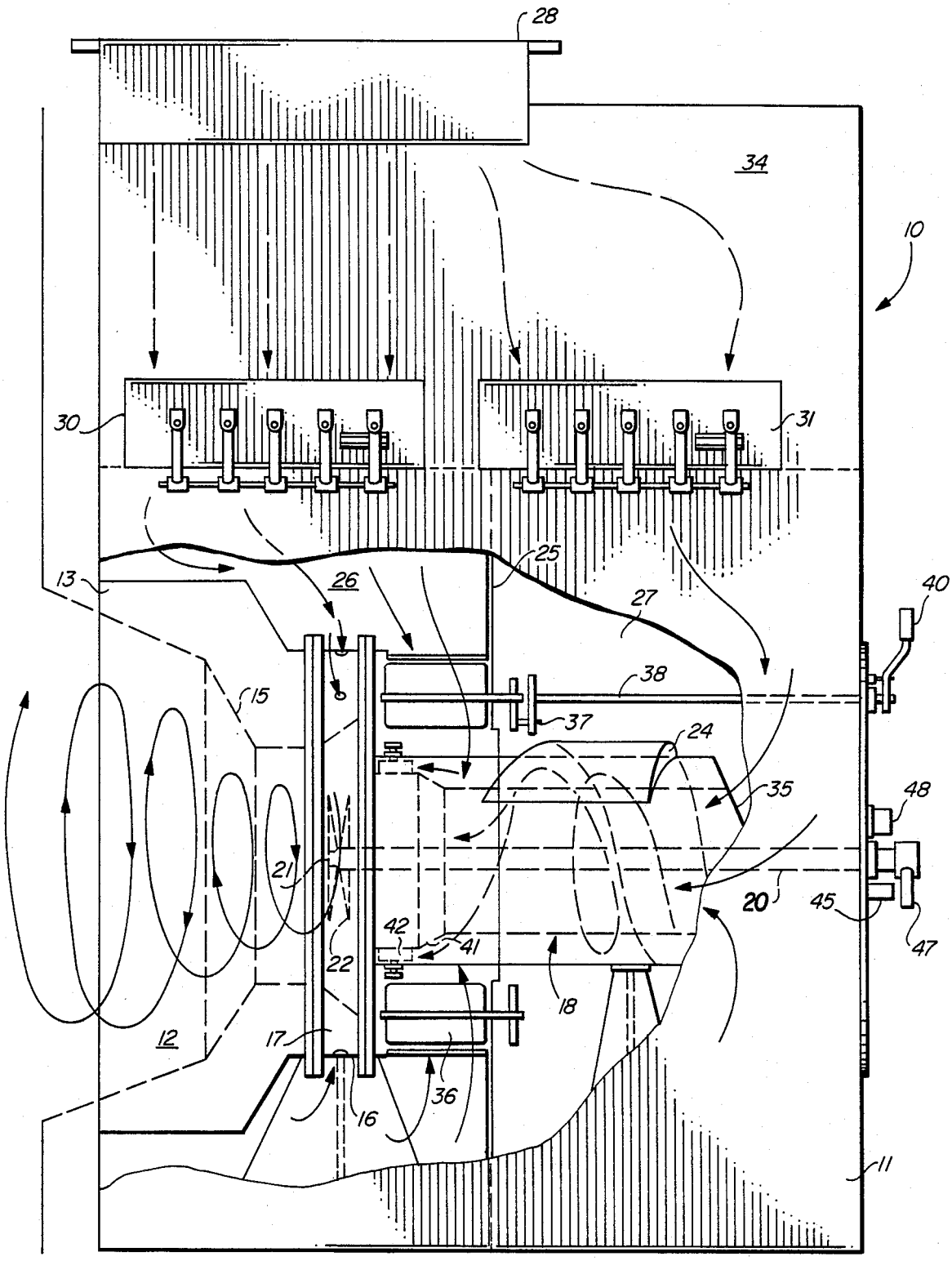
FIG. 1 is a cutaway side elevation of a solid fuel burner in accordance with the present invention.
Figure 3:
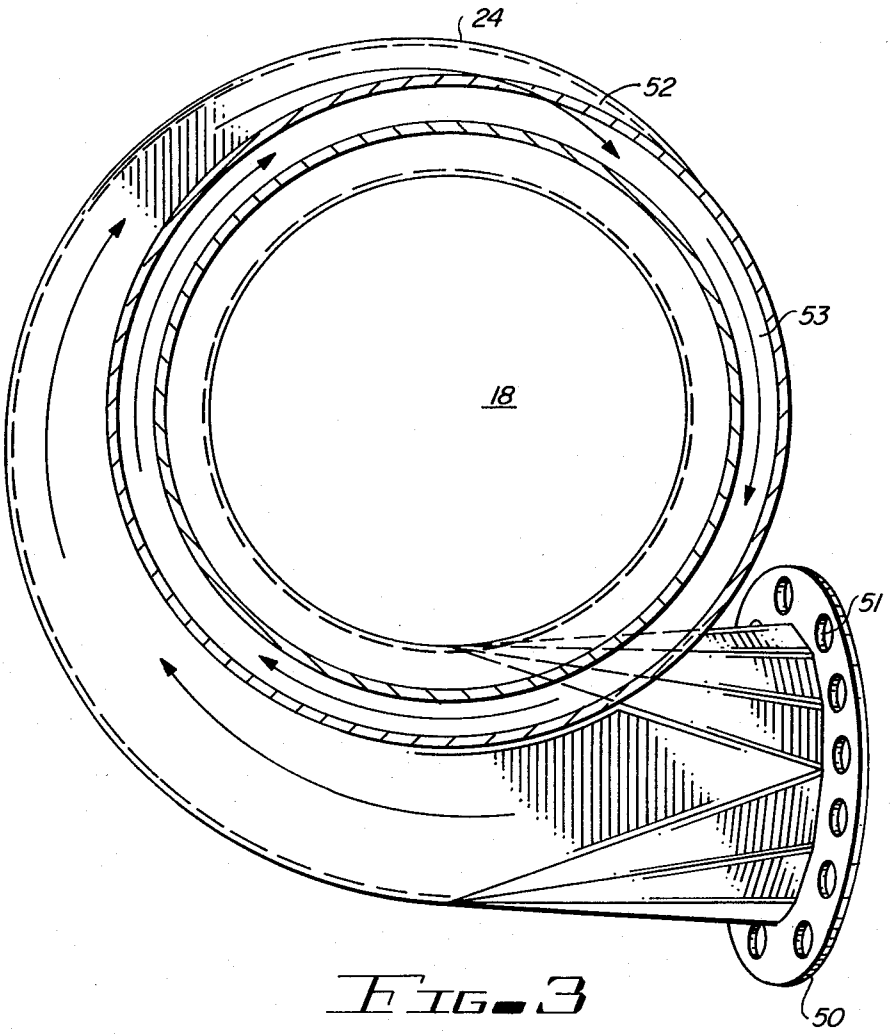
FIG. 3 is a sectional view of a solid fuel and primary air input to the burner of FIGS. 1 and 2.

Referring to the drawings, a solid fuel burner 10 is illustrated having a casing or housing 11, a combustion chamber 12, only a portion of which is shown, but which has a refractory lining 13. A combustion chamber 12 has a throat 14 and an expansion area 15 and is connected by an air cooled conduction barrier 16 having a plurality of apertures 17 therethrough. A solid fuel and primary air nozzle 18 is mounted in the burner 10 in the housing 11 and extends to the conduction barriers 16. An oil line 20 extends through the housing 11 and through the nozzle 18 to an oil nozzle 21 located in the annular shaped conduction barrier 16 and has a diffuser plate 22 attached thereto. Pulverized solid fuel and primary air is fed into an inlet 23 passing through the housing 11 at an angle and spirals around the nozzle 18 with the spiral input portion 21 which, as seen in FIGS. 1 and 3, has a narrowing passageway in one dimension while an expanding passageway in another dimension to spread out the air and solid fuel while increasing its velocity as it enters the solid fuel and primary air nozzle 18 at a tangent or angle produce a spiralling flow of the air and solid fuel entering the nozzle 18. The housing 11 is divided into two compartments by bulk head wall 25 with nozzle 18 passing therethrough so that a first or front compartment 26 is formed and a rear or second compartment 27 is formed by the housing 11 and bulk head wall 25. Input secondary air under pressure enters the housing 11 at the input opening 28 is proportioned between the compartments 26 and 27 by adjustable dampers 30 and 31. Adjustable damper 30 directs air into the compartment 26 while the adjustable damper 31 directs air into the compartment 27. The dampers can be opened separately by differing degrees, so that air entering 28 is fed to the compartments responsive to the position of the dampers which are locked in place for any particular fuel. This allows different amounts of air to be fed to the different compartments and to the combustion chamber 12 from two different directions and in varying amounts and directions of spin, which can be used to adjust the flame and to adjust the burner for different solid fuels. Damper 30 has handles 32 thereon, while damper 31 has handles 33 thereon for adjusting the dampers and locking them from outside of the housing 11 so that air entering 28 into a housing chamber 34 is then proportioned by the dampers 30 and 31 into compartments 26 and 27. Air entering the compartment 27 is fed through the end 35 of the nozzle 18 which has an open end portion in the housing compartment 27 and is pushed through the nozzle 18 past the diffusion plate 22 and into combustion chamber 12 and interacts with the spiralling solid fuel and primary air entering the nozzle 18 through the inlet 23 and through the spiralling input portion 24. The secondary air from compartment 27 is also fed into an annular opening 41 around the nozzle 18 and bottom deflector vanes 42 on shafts 43 therein. The deflector vanes 42 spiral the air passing through opening 41 in the same direction of rotation as the primary and secondary air passing through nozzle 18. Both the secondary air passing through the nozzle 18 in the primary air and solid fuel are forced by the diffusion plate 22 to continue the rotation in the same direction of the spiral from the input primary air and are fed into the throat area 15 with a rapid spinning high velocity to interact with the secondary air proportioned to chamber 26, which is spinning in the opposite direction by air registers 36 directing the air through an annular opening 49 and with the oil gun 21 directing a fuel spray directly into throat 14.

The plurality of air registers 36 may be connected through a rotating linkage 37 through a handle 38 to an air register adjustable lever 40 for adjusting the air registers for feeding the direction of the air from the compartment 26 to the combustion chamber. The air passing the air registers 36, then passes through an annular narrowed area 49 which acts as a venturi to increase the velocity of the flow of the air passing into the throat of the combustion chamber and to increase the spin or rotation of the air with the registers 36. which direct the direction of the air into a rotation opposite that of the rotation of the air and solid fuel entering from the solid fuel nozzle 18 into the combustion chamber. This produces a turbulent flame for mixing the secondary air and pulverized fuel and primary air in the combustion chamber and permits control of the flame length as well as keeping the oil atomizer from the oil gun 21 clean of solid fuel passing thereby in a swirling cyclone-like vortex.

The air cooled conduction barrier 16 allows the flow of air therearound through the apertures 17 to keep the barrier cool adjacent the refractory material which is heated by the combustion chamber and which transfers heat to the incoming air into the compartment 26. The secondary air passing through the compartment 26 both cools the refractory material as well as adding additional heat to the air to increase the efficiency of the burner.

Figure 2:
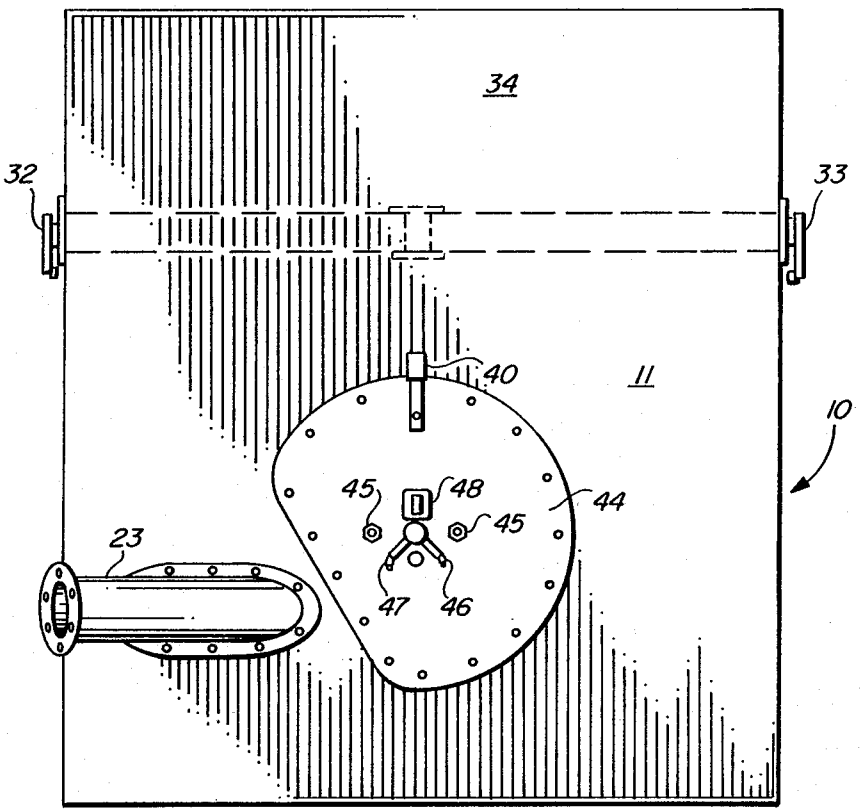
FIG. 2 is an end elevation of the burner in accordance with FIG. 1.

As seen in FIG. 2, a housing 11 has a removable portion 44 having the air register adjustable lever 40 connected therethrough and would typically have a side port 45, an oil inlet 46, a steam inlet 47 and an ignitor 48. The steam inlet 47 and the oil inlet 46 form a part of the oil gun assembly which is fed through the oil gun tube 20 to the nozzle 21 of the oil gun. The primary air and solid fuel input is more clearly seen in FIG. 3, in which the inlet has a flanged opening 50 having a plurality of apertures 51 therethrough for attaching to a pipe for the feeding of the pulverized fuel, which may be fed from a hammermill, or the like, with the primary air in a spiralling pattern 24 which narrows at 52 while expanding, as shown in FIG. 1, just prior to entering a passageway 53, circling the nozzle 18 and entering the nozzle in a spiraling pattern for interaction with the secondary air entering the end 35 of the nozzle 18 prior to impinging upon the diffuser plate 22.

Figure 5:
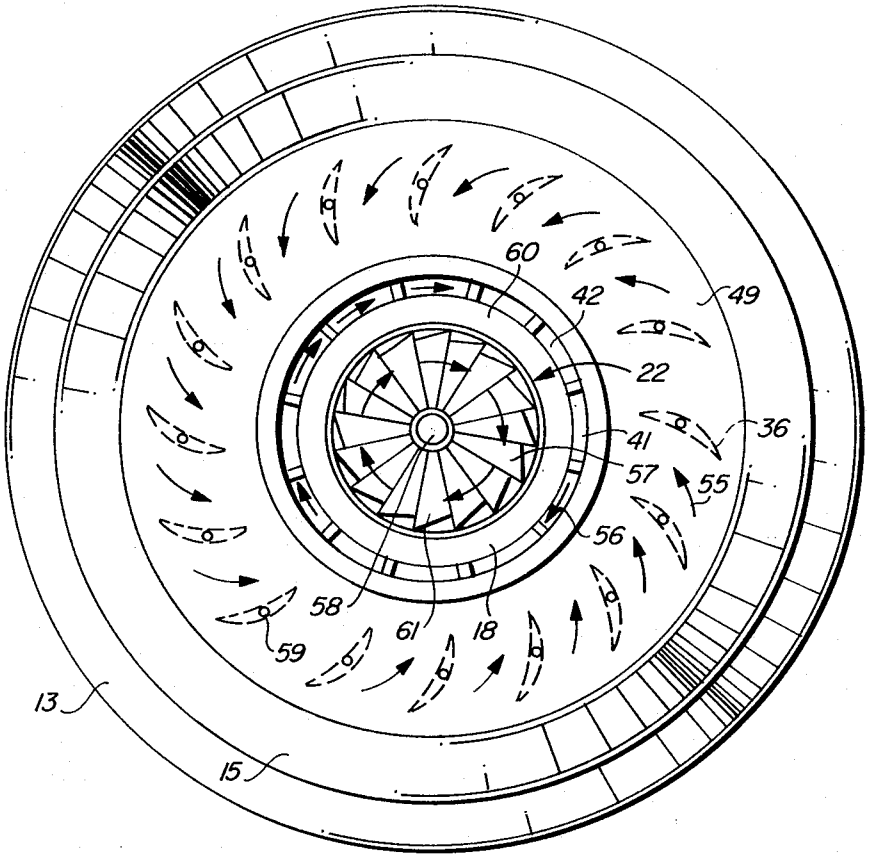
FIG. 5 is a sectional view taken on line 5—5 of FIG. 4.
Figure 4:
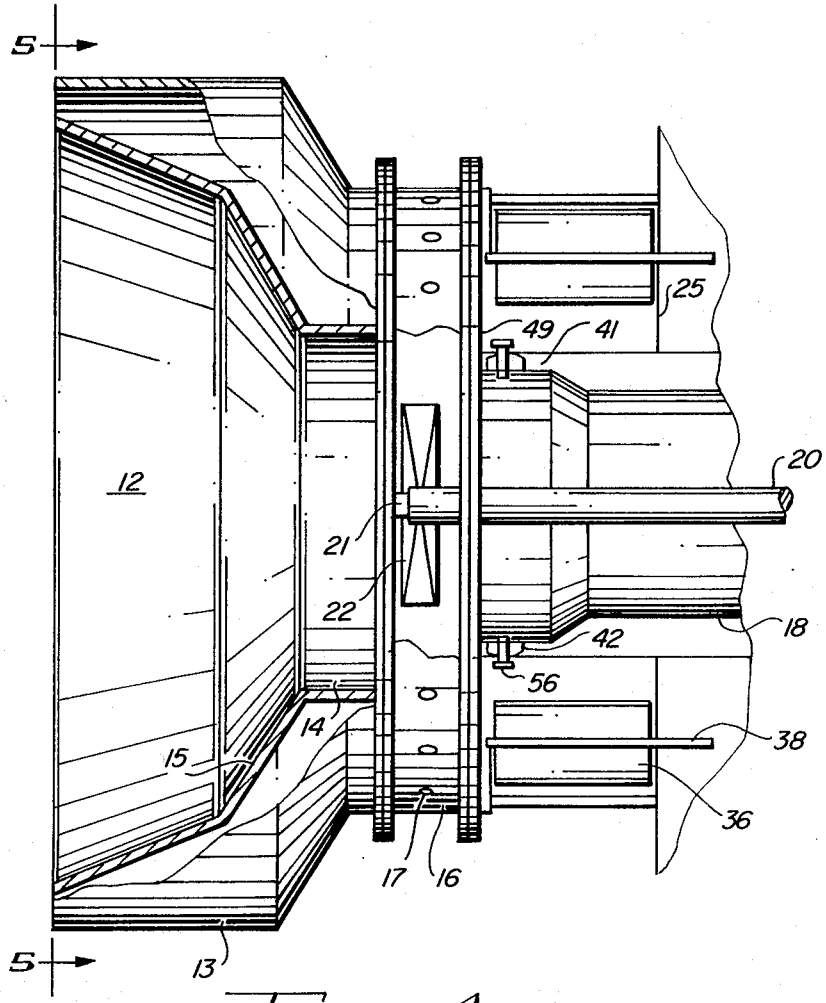
FIG. 4 is a sectional view of a portion of a solid fuel burner in accordance with the present invention.

Turning to FIG. 5, the flow of the primary and secondary air and solid fuel can be more clearly seen by arrows 55 showing the secondary air direction of rotation from the compartment 26 as directed by the air registers 36 mounted to the shafts 59 and is fed to the combustion chamber through the annular opening 49. Secondary air for compartment 27 is directed by the deflector vanes 41, adjustably attached with shafts 43. The direction of air rotation is shown by arrows 56 through opening 41. The diffuser plate 22 can be seen to have a plurality of blades 57 surrounding the nozzle 58 of the oil gun and attached thereto, but leaving an annular open space 60 therearound. The solid fuel and primary air nozzle 18 and secondary air passes through and around the diffuser 22 which rotates the air as shown by arrows 61. Thus, three different paths of air enter the combustion chamber with the outer opening spiralling in a direction opposite the inner coaxial opening and center nozzle output to provide the divided flame when properly proportioned for a particular fuel.

It should be clear at this point that a solid fuel burner has been shown and which is especially adapted to burn solid fuels such as pellets of biomass material which have been previously pulverized by hammermill, which is especially adapted to provided a high efficiency burn utilizing an oil gun assembly, or alternatively, a gas gun can be utilized without departing from the spirit and scope of the invention.

It should also be clear that proportioning of the air as well as the careful adjustment of the direction of rotation of the different proportions of the secondary end primary air are utilized to provide a more complete burn utilizing a high velocity and high turbulence reaction area in the throat of the burner. However, the present invention is not to be construed as limited to the forms shown, which are to be considered illustrative rather than restrictive.

I claim:

1. A solid fuel burner comprising in combination:

a combustion chamber;

a housing;

a solid fuel and primary air nozzle attached to the combustion chamber through the housing for directing pulverized solid fuel and primary air to the combustion chamber;

a solid fuel and primary air input connected to the solid fuel and primary air nozzle for directing solid fuel and air thereinto;

a secondary air input means for directing air under pressure through said housing into said combustion chamber;

a housing dividing means dividing the housing into first and second compartments;

proportioning means for directing the input secondary air between said housing first and second compartments, the first compartment directing air into said combustion around said solid fuel and primary air nozzle and the second compartment directing air through said solid fuel and primary air nozzle and around said solid fuel and primary nozzle, said proportioning means including a plurality of adjustable dampers for directing predetermined proportions of secondary air between said first and second housing compartments whereby a two zoned secondary air control may be used in adjusting the flame of a solid fuel burner;

a plurality of registers located in said solid fuel burner for directing the secondary air from said housing first compartment to said combustion chamber in one direction of rotation;

a plurality of vanes located in said housing around said solid fuel and primary air nozzle for directing a portion of the secondary air from said second compartment into said combustion chamber in a second direction of rotation;

a solid fuel and primary air diffuser mounted at the output of said solid fuel and primary air nozzle for rotating solid fuel and air passing through said solid fuel and primary air nozzle in said second direction of rotation and an air cooled annular shaped metal conduction barrier having a plurality of apertures therein mounted to said combustion chamber adjacent the inlet of secondary and primary air into said combustion chamber, whereby said conduction barrier is air cooled by the incoming air.

2. A solid fuel burner in accordance with claim 1, in which said solid fuel and primary air spiralling input widens as the input passageway approaches the solid fuel and primary air nozzle.

3. A solid fuel burner in accordance with claim 1, in which said plurality of dampers have external handles attached thereto located on said burner housing and having locking means for holding said dampers in place in a predetermined position.

4. A solid fuel burner in accordance with claim 1, in which said plurality of registers are connected by a linkage to a handle located on the exterior surface of said solid fuel burner and housing for adjusting said registers to thereby adjust the flame in said solid fuel burner combustion chamber.

5. A solid fuel burner in accordance with claim 1, in which said solid fuel and primary air input enters said housing at an angle to said solid fuel and primary air nozzle to begin the spiral on said solid fuel and primary air input.

* * * * *